US007735653B2

(12) United States Patent
Musschoot et al.

(10) Patent No.: US 7,735,653 B2
(45) Date of Patent: Jun. 15, 2010

(54) VIBRATORY SAND RECLAIMING APPARATUS HAVING NORMAL AND REJECT MODES

(75) Inventors: Paul Musschoot, Marengo, IL (US); William G. Guptail, Elgin, IL (US); Steve C. Wiechmann, Sleepy Hollow, IL (US)

(73) Assignee: General Kinematics Corporation, Crystal Lake, IL (US)

( * ) Notice: Subject to any disclaimer, the term of this patent is extended or adjusted under 35 U.S.C. 154(b) by 0 days.

(21) Appl. No.: 11/775,756

(22) Filed: Jul. 10, 2007

(65) Prior Publication Data

US 2008/0017554 A1 Jan. 24, 2008

Related U.S. Application Data

(63) Continuation of application No. 10/427,200, filed on May 1, 2003, now Pat. No. 7,240,800.

(60) Provisional application No. 60/377,848, filed on May 3, 2002.

(51) Int. Cl.
*B07B 1/46* (2006.01)
*B07B 1/28* (2006.01)
*B07B 13/00* (2006.01)

(52) U.S. Cl. ..... 209/255; 209/309; 209/680

(58) Field of Classification Search ..... 209/260, 209/691, 698, 255, 309, 680, 689, 234, 235
See application file for complete search history.

(56) References Cited

U.S. PATENT DOCUMENTS 3,762,547 A 10/1973 Stirk (Continued)

FOREIGN PATENT DOCUMENTS

JP 10-000430 1/1998

(Continued)

OTHER PUBLICATIONS

International Search Report for International Patent Application No. PCT/US03/13284, dated Jan. 2, 2004, 8 pages.

(Continued)

*Primary Examiner*—Patrick Mackey
*Assistant Examiner*—Mark Hageman
(74) *Attorney, Agent, or Firm*—Marshall, Gerstein & Borun LLP

(57) ABSTRACT

An attrition mill for reclaiming foundry sand from deposited material having lumps of used foundry sand and included material includes a housing defining a chamber for receiving the lumps of used foundry sand and included material. A base is disposed within the housing and has an elevated end defining a reject outlet adjacent a reject end of the mill and a lower end, and a discharge wall is positioned adjacent the base lower end to define a sand outlet adjacent a sand end of the mill. A resilient support is attached to the housing, and a vibratory drive is attached to the housing and includes first and second eccentrically loaded motors. The vibratory drive is selectively operable in a normal mode, in which the first and second motors are rotated to generate a vibratory force in a first direction that advances the deposited material generally toward the sand outlet, and a reject mode, in which at least one of the first and second motors is operated to generate a vibratory force in a second direction that advances the deposited material generally toward the reject outlet.

17 Claims, 3 Drawing Sheets

U.S. PATENT DOCUMENTS

| | | | | |
|---|---|---|---|---|
| 3,793,780 | A | | 2/1974 | Musschoot |
| 4,025,419 | A | * | 5/1977 | Musschoot ..... 209/3 |
| 4,152,255 | A | * | 5/1979 | Musschoot ..... 209/234 |
| 4,196,637 | A | | 4/1980 | Barrot et al. |
| 4,299,692 | A | * | 11/1981 | Musschoot ..... 209/1 |
| 4,415,444 | A | | 11/1983 | Guptail |
| 4,709,507 | A | | 12/1987 | Musschoot |
| 4,742,721 | A | | 5/1988 | Pouillon et al. |
| 4,913,804 | A | | 4/1990 | Muller |
| 4,926,601 | A | | 5/1990 | Musschoot |
| RE33,542 | E | | 2/1991 | Musschoot |
| 5,037,535 | A | | 8/1991 | Bruderlein et al. |
| 5,512,008 | A | | 4/1996 | Musschoot |
| 5,591,074 | A | | 1/1997 | Musschoot |
| 5,615,763 | A | | 4/1997 | Schieber |
| 5,666,852 | A | | 9/1997 | Musschoot |
| 5,713,457 | A | | 2/1998 | Musschoot |
| 5,896,998 | A | * | 4/1999 | Bjorklund et al. ..... 209/326 |
| 5,901,775 | A | | 5/1999 | Musschoot et al. |
| 5,924,473 | A | | 7/1999 | Musschoot |
| 5,967,222 | A | | 10/1999 | Musschoot et al. |
| 5,984,107 | A | | 11/1999 | Bleh |
| 6,029,796 | A | | 2/2000 | Musschoot |
| 6,349,834 | B1 | | 2/2002 | Carr et al. |
| 6,453,982 | B1 | | 9/2002 | Musschoot et al. |
| 6,513,664 | B1 | | 2/2003 | Logan et al. |
| 6,679,385 | B2 | | 1/2004 | Suter et al. |
| 6,988,624 | B2 | * | 1/2006 | MacNaughton ..... 209/420 |
| 7,240,800 | B2 | | 7/2007 | Musschoot et al. |

FOREIGN PATENT DOCUMENTS

| | | |
|---|---|---|
| JP | 2002-119921 | 4/2002 |

OTHER PUBLICATIONS

"VIBRA-MILL VMC", Bulletin 482, General Kinematics Corporation, 1982, 2 pages.

"VIBRA-MILL", Bulletin No. 480, General Kinematics, 1980, 8 pages.

* cited by examiner

VIBRATORY SAND RECLAIMING APPARATUS HAVING NORMAL AND REJECT MODES

The present application is a continuation of U.S. application Ser. No. 10/427,200, filed on May 1, 2003, issued as U.S. Pat. No. 7,240,800, which claims the benefit of U.S. Provisional Application No. 60/377,848, filed May 3, 2002, both of which are hereby incorporated by reference in their entirety in the present application.

BACKGROUND

The present invention generally relates to vibratory process apparatus and, more particularly, to vibratory sand reclaiming apparatus and methods.

In foundry operations, molten metal is often cast in a sand mold. To retain the shape of the mold, the sand may be treated with a resin binder, and may include imbedded metal reinforcing cores or rods for additional strength. To reduce costs, it is beneficial to reclaim the sand for reuse in subsequent molding operations.

Various types of sand reclaiming devices and methods are generally known in the art. For example, U.S. Pat. No. 4,025,419 to Musschoot and U.S. Pat. No. 4,415,444 to Guptail, which have a common assignee as the present invention, disclose vibratory sand reclaiming apparatus. In these patents, sand lumps are introduced into a vibrating chamber where they are agitated and abrade each other to produce discrete sand particles. A pair of motors having eccentrically loaded shafts are attached to the chamber and operated in opposite directions to generate a vibratory agitating motion. Sand grains freed from the clumps pass through an exit screen to be collected for reuse.

In addition to the lumps of used foundry sand, additional included material, such as metal rods, cores, or other irreducible material, may also be deposited into the chamber. Over time, the included material accumulates in the chamber and must be removed. Accordingly, the previously known sand reclaiming devices include a third motor attached to the chamber which, when operated simultaneously with one of the other two motors, generates a vibratory motion in a reverse direction toward a reject outlet. As a result, the included material may be discharged from the chamber. While the devices described in the '419 and '444 patents reduce sand lumps in a satisfactory manner and allow for easy removal of included materials, they are overly complex and expensive to build.

Prior vibratory sand reclamation devices also include overly costly gates to close off the reject outlet during normal operation. Such gates typically include a seal for tightly closing off the outlet. The seals, however, are subject to wear and therefore deteriorate quickly, necessitating frequent replacement. In addition, the gates often include an actuator, such as a pneumatic cylinder, and linkage for moving the gate between open and closed positions. The actuator and linkage, however, increase the complexity and cost of the device.

DETAILED DESCRIPTION

Figure 1:
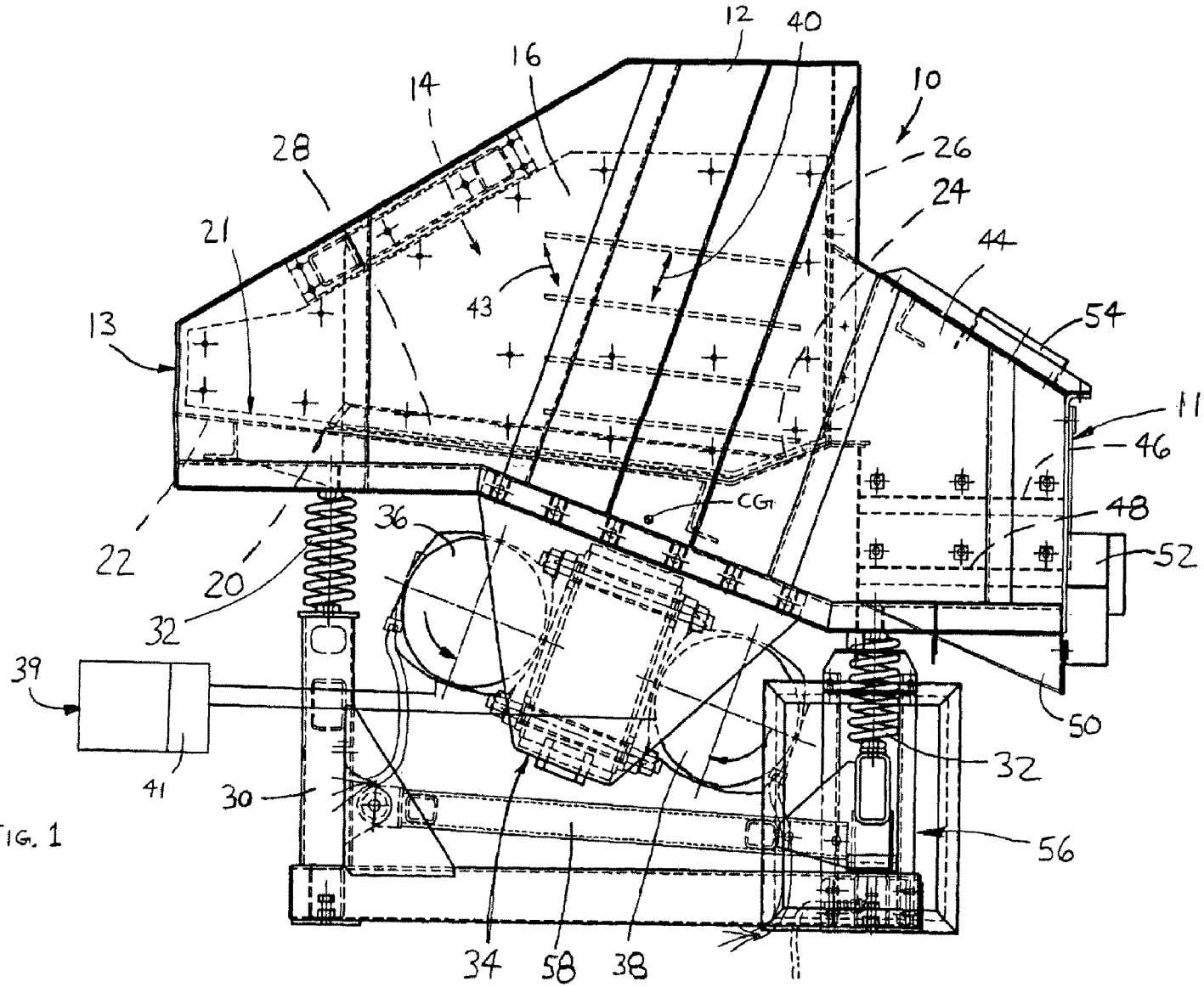
FIG. 1 is a side elevation view of an attrition mill constructed in accordance with the teachings of the present invention.
Figure 2:
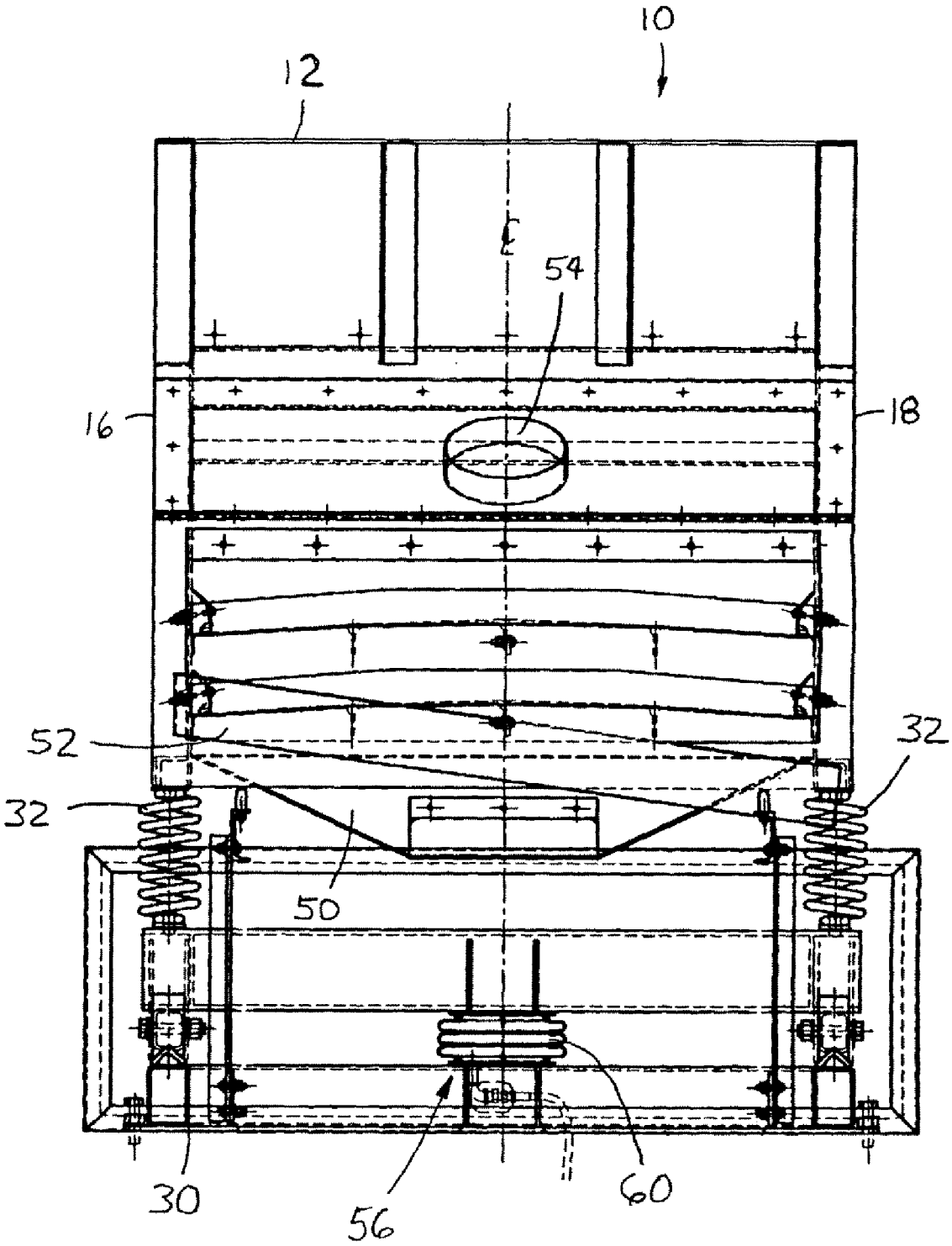
FIG. 2 is a front elevation view of the attrition mill of FIG. 1.
Figure 3:
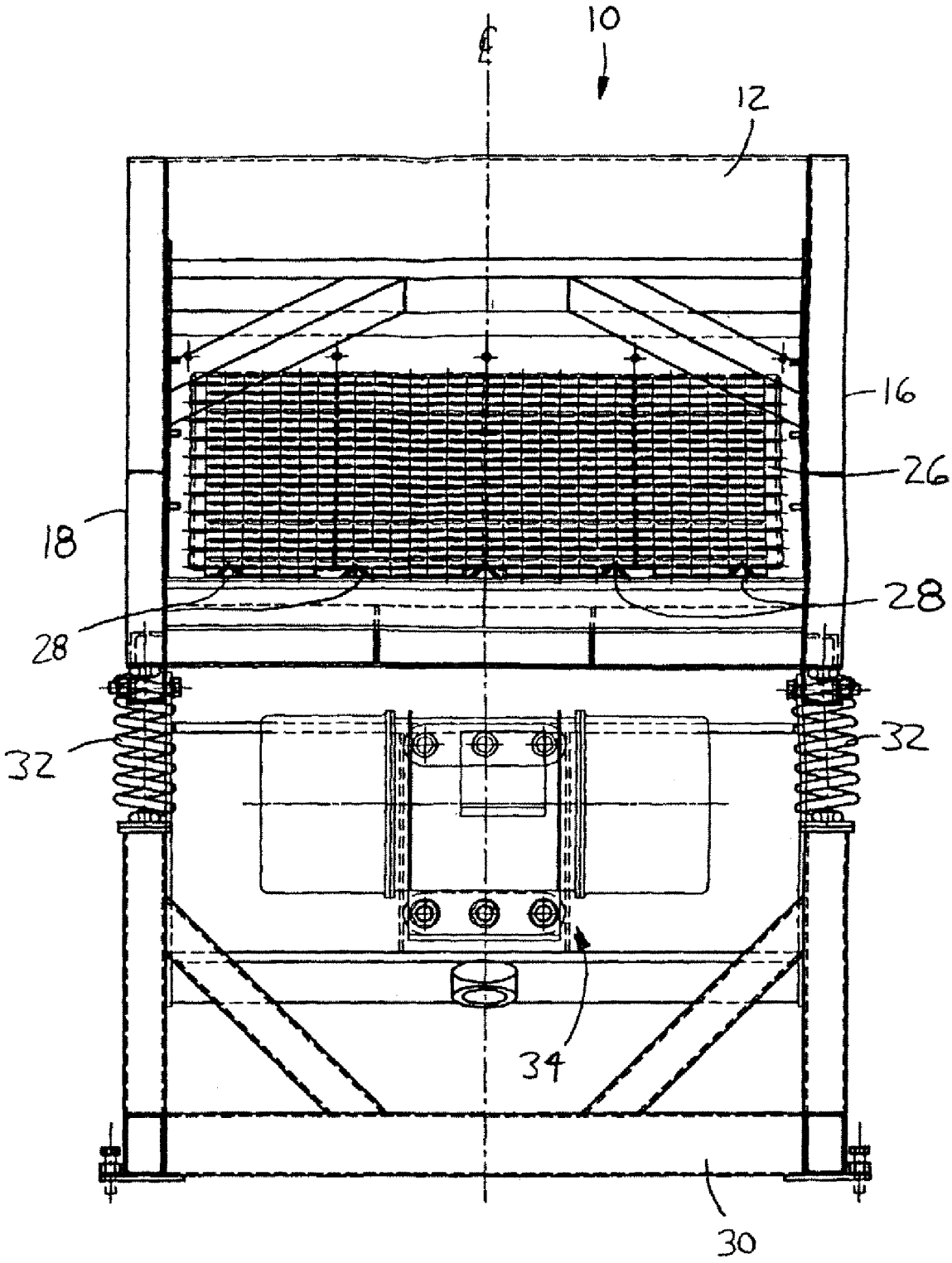
FIG. 3 is a rear elevation view of the attrition mill of FIG. 1.

FIGS. 1-3 illustrate an attrition mill 10 constructed in accordance with the teachings of the present invention. As described herein, the attrition mill 10 receives deposited material, which may comprise lumps of used foundry sand and included material. As used herein, "included material" refers to metal rods, cores, oversized lumps of sand, and any other materials that are incapable of being reduced by the attrition mill 10. Reclaimed sand is discharged from a sand end 11 of the mill, while included material may be selectively discharged from a reject end 13 of the mill, as described in greater detail below.

The attrition mill 10 includes a housing 12 which defines a chamber 14 for receiving the lumps of used foundry sand and included material. The housing 12 includes opposed side walls 16, 18 attached to each other by a base 20 extending therebetween. Top edges of the side walls 16, 18 are uncovered, so that access to the chamber 14 may be obtained through a top of the housing 12. The base 20 is arranged on an incline to define an elevated end 22 and a lower end 24. The incline of the base 20 may be selected according to the angle of repose of the sand material.

According to the exemplary embodiment, the base 20 includes an extension section 21 which eliminates the need for a gate or other restriction at the elevated end 22. The base extension section 21 increases the overall base length to provide sufficient space between the base lower end 24 and the base elevated end 22, so that the discharge of sand over the elevated end 22 during normal operation is prevented. As a result, the attrition mill 10 provides a gateless or unrestricted base elevated end 22.

A discharge wall, such as a perforated screen 26, is positioned adjacent the base lower end 24, and extends in a generally vertical direction. The perforations in the screen 26 define a sand outlet through which grains of sand separated from the lumps may pass. A plurality of longitudinally extending ribs 28 extending substantially the length of the chamber 14 may be attached to the base 20. The ribs may include gaps for introducing cooling air into the chamber, as described in greater detail in U.S. Pat. No. 4,415,444, which issued on Nov. 15, 1983, to Guptail, and is incorporated herein by reference.

The housing 12 is carried by a resilient support. In the exemplary embodiment, the resilient support includes a lower frame 30 and a plurality of springs 32 extending from the lower frame 30 to the housing 12. The springs 32 allow the housing 12 to vibrate while minimizing vibration forces imparted to the floor on which the mill 10 is supported.

A vibratory drive 34 is attached to the housing 12 for generating a vibratory motion in the chamber 14. The vibratory drive 34 includes a first motor 36 and a second motor 38. As is generally known in the art, each motor 36, 38 includes a shaft having an eccentric weight so that, when the shafts are rotated, the attached housing 12 will vibrate. The housing 12 and attached vibratory drive 34 define a center of gravity CG of the mill 10, as best shown in FIG. 1. In certain embodiments, the motors 36, 38 may be positioned on opposite lateral sides of the center of gravity CG, so that the first motor 36 is positioned on a sand end side of the center of gravity CG while the second motor 38 is positioned on a reject end side of the center of gravity CG. In other embodiments, the motors 36, 38 need not be placed on opposite lateral sides of the center of gravity CG, as described in greater detail below.

A controller 39 is operably coupled to the first and second motors 36, 38 for operating the motors in both a normal mode and a reject mode, as schematically illustrated in FIG. 1.

During normal mode operation, the first and second motors 36, 38 may be counter-rotated (i.e., rotated in opposite directions) to produce a vibratory motion which agitates the deposited material and drives it toward the perforated screen 26. In an exemplary embodiment, the first motor 36 may be rotated in a counter-clockwise direction while the second motor 38 is rotated in a clockwise direction, as indicated by the arrows on the motors 36, 38 in FIG. 1. The resulting vibratory force acts through the center of gravity CG in the direction indicated by double ended arrow 40. As a result, the lumps of used foundry sand and included material deposited on the base 20 are advanced toward the base lower end 24. The lumps in the chamber 14 rub against one another to remove sand in the form of discrete particles. The sand so removed builds up as a body of sand on top of the base 20, and the accumulation of sand with the vibratory movement will advance the discrete sand particles through the perforated screen 26.

After some period of use, included material will accumulate in the bottom of the chamber 14. To remove included material from the chamber, the vibratory drive 34 is operable in the reject mode. During the reject mode, at least one of the motors 36, 38 is rotated to produce a vibratory force that advances the deposited material toward the reject outlet. When the first and second motors 36, 38 are positioned on opposite lateral sides of the center of gravity CG, the second motor 38 may be operated alone to generate a vibratory force that conveys the included material to the reject end of the mill. In this embodiment, the vibratory force generated by the second motor 38 is elliptical near the center of gravity CG but gradually becomes more of a straight-line force near the base elevated end 22. While the motor 38 may be driven in either direction, it is preferably rotated in a counter-clockwise direction as shown in FIG. 1. The vibratory force from the second motor 38 advances deposited material toward the elevated end 22 of the base. Operation of the second motor 38 may continue until the desired amount of included material is advanced over the base elevated end 22. Accordingly, the base elevated end 22 defines a reject outlet for the included material.

Alternatively, both the first and second motors 36, 38 may be operated simultaneously during the reject mode. In this embodiment, the locations of the first and second motors 36, 38 need not be on opposite lateral sides of the center of gravity CG. Instead, the controller 39 includes a motor drive, such as an encoder 41 (FIG. 1), to alter the relative positions of the eccentric weights carried by the first and second motors 36, 38, defined herein as the "phase angle" between the first and second motors 36, 38. The phase angle determines the direction of the vibratory force, and therefore altering the phase angle will modify the resulting vibratory force generated by the first and second motors. More specifically, in the normal mode, the vibratory force generated by the rotating motors 36, 38 may be directed up and toward the right as illustrated by double-ended arrow 40 in FIG. 1, so that material in the mill is advanced toward the perforated screen 26. In the reject mode, however, the encoder 41 may effect and maintain a modified phase angle between the first and second motors 36, 38 so that the direction of the resulting vibratory force shifts. Thus, the vibratory force generated by the motors 36, 38 in the reject mode is directed up and toward the left, as illustrated by the double ended arrow 43 in FIG. 1, so that material in the mill is advanced toward the base elevated end 22.

A method of reclaiming foundry sand is provided in which included materials may be simply and easily removed from the chamber 14. According to the method, the vibratory drive 34 of the attrition mill 10 is first operated in a normal mode in which lumps of used foundry sand are abraded and reduced. During normal mode, as noted above, the first and second motors 36, 38 are counter-rotated to generate a vibratory force in the direction indicated by the double-ended arrow 40 in FIG. 1. As a result, the used foundry sand and included material are advanced toward the perforated screen 26, so that sand particles librated from the lumps may pass through the sand outlet.

Subsequently, the vibratory drive is operated in a reject mode to remove included materials from the chamber 14. In one reject mode embodiment, only the second motor 38 is rotated to generate a vibratory motion which advances included material toward the base elevated end 22. Alternatively, the phase angle between the first and second motors 36, 38 may be altered so that the resulting vibratory force is directed up and toward the base elevated end 22. Operation of the vibratory drive 34 in the reject mode may continue until most or all of the included materials are discharged from the chamber 14 through the reject outlet defined by the base elevated end 22.

A portion of the chamber 14 downstream of the perforated screen 26 may define a screen housing 44. Upper and lower outlet screens 46, 48 may be disposed inside the screen housing 44 to classify and/or further process reduced lumps of sand. A fines chute 50 may be positioned below the lower outlet screen 48 for discharging fines. An overs chute 52 may be positioned above the lower outlet screen 48 for discharging particles that accumulate on the lower outlet screen. The screen housing 44 may further include an air takeoff 54 that is in fluid communication with a partial vacuum source. The air takeoff may be used to remove dust and/or further classify the particles discharged from the chamber 14.

To help discharge included material in the chamber 14 through the reject outlet, a lift 56 may be provided for elevating the sand end 11 of the attrition mill 10. In the exemplary embodiment, the lift 56 includes a lift frame 58 pivotably attached to the frame 30 and an expandable airbag 60 (FIG. 2) positioned between the lift frame 58 and the sand end 11 of the housing 12. A source of pressurized air is attached to the airbag 60 and regulated to selectively expand or contract the airbag 60. When the airbag 60 is expanded, the sand end 11 of the housing 12 is elevated, thereby allowing material in the chamber 14 to discharge from the reject outlet under the force of gravity. The lift 56 is optional in that it is not normally required to remove most of the included material in the chamber 14 through the reject outlet. Operation of the attrition mill 10 in the reject mode without the lift 56 typically results in removal of at least 50% and often 80% or more of the included materials deposited in the mill. The lift 56 may be used to increase the percentage of included materials removed from the mill 10, so that substantially all of the included materials are removed.

Although certain apparatus constructed in accordance with the teachings of the invention have been described herein, the scope of coverage of this patent is not limited thereto. On the contrary, this patent covers all embodiments of the teachings of the invention fairly falling within the scope of the appended claims either literally or under the doctrine of equivalents.

What is claimed is:

1. An attrition mill for reclaiming foundry sand from deposited material having lumps of used foundry sand and included material, the attrition mill comprising:

a housing defining a chamber for receiving the lumps of used foundry sand and included material, the chamber having an opening through the top of the housing; and a base disposed within the housing and having an elevated end defining a reject outlet adjacent a gateless reject end of the mill and a lower end, the lower end being downstream from the opening;

the base including an extension section upstream from the opening and defining the gateless reject end;

a discharge wall positioned adjacent the base lower end defining a sand outlet adjacent a sand end of the mill;

a resilient support attached to the housing; and a vibratory drive attached to the housing and including first and second eccentrically loaded motors;

a controller operably coupled to the first and second motors, the controller selectively operating the first and second motors in a normal mode, in which the first and second motors are rotated to generate a vibratory force in a first direction that advances the deposited material generally toward the sand outlet and the gateless reject end is unrestricted, and a reject mode, in which at least one of the first and second motors is operated to generate a vibratory force generally in a second direction that advances the deposited material generally toward the reject outlet and the gateless reject end is unrestricted;

the extension section creating an overall base length that sufficiently spaces the base lower end and the gateless base reject end to retain the deposited material within the chamber during operation of the vibratory drive.

2. An attrition mill according to claim 1, in which the first and second motors are positioned on opposite lateral sides of a center of gravity of the mill, wherein the first motor is positioned on a reject end side of the center of gravity while the second motor is positioned on a sand end side of the center of gravity.

3. An attrition mill according to claim 2, in which the controller operates only the second motor in the reject mode to generate the vibratory force in the second direction.

4. An attrition mill according to claim 1, in which the controller further comprises a motor drive operably coupled to the first and second motors for selectively adjusting a phase angle between the first and second motors.

5. An attrition mill according to claim 4, in which the motor drive modifies the phase angle between the first and second motors and the controller operates both the first and second motors in the reject mode to generate the vibratory force in the second direction.

6. An attrition mill according to claim 1, in which the resilient support comprises a plurality of springs.

7. An attrition mill according to claim 1, further comprising a lift frame attached to the resilient support for raising the sand end of the mill.

8. An attrition mill according to claim 7, in which the lift frame includes an airbag having a deflated state and an inflated state, and in which the sand end is raised relative to the reject end with the airbag in the inflated state to permit deposited material to move toward the reject end under the force of gravity.

9. An attrition mill according to claim 1, in which the controller counter-rotates the first and second motors in the normal mode to generate the vibratory force in the first direction.

10. An attrition mill according to claim 1, in which the discharge wall includes a perforated screen.

11. A method of reclaiming foundry sand from deposited material having lumps of used foundry sand and included material in an attrition mill having a housing for receiving the deposited material and a vibratory drive attached to the housing, the housing defining a sand end for discharging reclaimed sand and a gateless reject end for discharging included material, the housing defining a chamber having an opening through the top of the housing, the sand end being downstream from the opening, the vibratory drive including first and second motors carrying eccentric weights, and a base disposed within the housing and having an elevated end including an extension section upstream from the opening defining the gateless reject end the method comprising:

operating the vibratory drive in a normal mode, in which the first and second motors are rotated to generate a vibratory force that advances the deposited material in a first direction generally toward the sand end and breaks up the lumps of used foundry sand; and selectively operating the vibratory drive in a reject mode, in which at least one of the first and second motors is operated to generate a vibratory force that advances the deposited material generally in a second direction generally toward the gateless reject end, wherein the gateless reject end is unrestricted in the normal and reject modes.

12. A method according to claim 11, in which the attrition mill defines a center of gravity, and in which the first and second motors are positioned on opposite lateral sides of the center of gravity of the mill, wherein the first motor is positioned on a reject end side of the center of gravity while the second motor is positioned on a sand end side of the center of gravity.

13. A method according to claim 12, in which operation in the reject mode comprises operating only the second motor to generate the vibratory force in the second direction.

14. A method according to claim 11, in which the attrition mill includes a motor drive operably coupled to the first and second motors, wherein the motor drive selectively adjusts a phase angle between the first and second motors.

15. A method according to claim 14, in which operation in the reject mode comprises modifying the phase angle between the first and second motors and operating both the first and second motors to generate the vibratory force in the second direction.

16. A method according to claim 11, in which an inclined base is disposed in the chamber having an elevated end and a lower end, and in which the deposited material is advanced over the elevated end during the reject mode.

17. A method according to claim 11, wherein the extension section creates an overall base length that sufficiently spaces the sand end and the reject end to retain the deposited material within the housing during operation of the vibratory drive.

* * * * *